US007604554B2

(12) United States Patent
Otsubo

(10) Patent No.: US 7,604,554 B2
(45) Date of Patent: Oct. 20, 2009

(54) GOLF TEE

(76) Inventor: Hirofusa Otsubo, 60-16 83rd Pl., Middle Village, NY (US) 11379

( * ) Notice: Subject to any disclaimer, the term of this patent is extended or adjusted under 35 U.S.C. 154(b) by 52 days.

(21) Appl. No.: 12/011,714

(22) Filed: Jan. 29, 2008

(65) Prior Publication Data

US 2009/0191983 A1 Jul. 30, 2009

(51) Int. Cl.
*A63B 57/00* (2006.01)

(52) U.S. Cl. ..... 473/387; 473/401

(58) Field of Classification Search ..... 473/387–403; D21/717, 718

See application file for complete search history.

(56) References Cited

U.S. PATENT DOCUMENTS

| | | | | | |
|---|---|---|---|---|---|
| 1,623,782 | A | | 4/1927 | Dent | |
| 1,645,001 | A | * | 10/1927 | Hodges | 473/399 |
| 2,455,705 | A | * | 12/1948 | Seager | 473/402 |
| 2,531,470 | A | * | 11/1950 | Rickard | 473/396 |
| 4,192,504 | A | * | 3/1980 | Clugage | 473/403 |
| D271,509 | S | * | 11/1983 | Hanson | D21/718 |
| 4,645,208 | A | | 2/1987 | Morabeto | |
| 4,783,077 | A | * | 11/1988 | Lemon | 473/402 |
| 4,905,999 | A | * | 3/1990 | Voinovich et al. | 473/386 |
| 5,085,431 | A | * | 2/1992 | McGuire | 473/398 |
| 5,242,170 | A | | 9/1993 | Ward | |
| 5,413,348 | A | | 5/1995 | Basso | |
| 6,010,413 | A | * | 1/2000 | Pan-Chung | 473/402 |
| 7,011,586 | B2 | | 3/2006 | Toyosawa et al. | |
| 7,066,844 | B1 | * | 6/2006 | Noggle | 473/387 |
| 7,156,758 | B2 | | 1/2007 | Lu | |
| 2002/0198066 | A1 | * | 12/2002 | Salsman | 473/387 |
| 2005/0064959 | A1 | | 3/2005 | Ortiz | |
| 2006/0276268 | A1 | * | 12/2006 | Hung | 473/387 |
| 2007/0202966 | A1 | * | 8/2007 | Lipidarov | 473/387 |
| 2008/0085786 | A1 | * | 4/2008 | Otsubo | 473/396 |

* cited by examiner

*Primary Examiner*—Steven Wong
(74) *Attorney, Agent, or Firm*—Day Pitney LLP

(57) ABSTRACT

There is disclosed a golf tee implementing an anchoring device, an impact energy deflection device and a friction reduction device in one-piece configuration. The tee anchoring device comprises two anchoring fins for initial impact resistance and the recoil dislodgement prevention fin after-impact resistance. The an energy deflection device of a gradual diameter reduction section minimizes the absorption of the impact energy by golf tee. The golf ball friction reduction device reduces less ball spin for more ball flight. The golf tee combined with these improvements, is made to stand with repeated use time after time.

6 Claims, 2 Drawing Sheets

GOLF TEE

FIELD OF THE INVENTION

The present invention relates to the sport of golf and, more particularly, to a golf tee for implementing various types of improvements in an one-piece configuration.

BACKGROUND OF THE INVENTION

In the sport of golf, the conventional golf tees still contain five major defects waiting to be solved all together in one piece golf tee configuration. The first one of the five defects is a loss of ball flight distance due to tees breakage resulting in loss of golf club impact energy absorption by tee braking. The second one is a ball flight reduction by ball friction against a concaved top surface of the tee which produces more unwanted ball spins, resulting in a reduction in ball flight distance. The third one is loss of ball flight direction by leaned ball to one side on a concaved top surface which produces more unwanted ball side spins, resulting in a reduction in ball flight direction. The forth one is loss of tees at the tee shot, requiring the golfer to keep spending time to find dislodged tees and a large quantity of tees is needed during one round of golf play. Lastly, golf tees must be strong enough to stand repeated use by the golfer.

The need to gain more ball flight distances from golf tees and the need to keep golf tees on the ground work in direct conflict with each other. For example, the need to anchor tees on the ground after impact requires the tees to hold the ground which absorbs club head impact energy, resulting in less energy transfer to the ball for maximum distance. On the other hand, a maximum flight distance of the ball requires the least of energy absorption due to loss of the tees.

In an attempt to overcome the breakage and loss problem a variety of tees have been suggested and produced. Although plastic tees are almost reusable, most of them are, unfortunately, ejected from the ground easily and the other are somewhat effective to stay on the ground, and their claimed anchoring abilities are limited and the worst of all, they cause a reduction in golf ball flight distance due to the impact energy absorption by the golf tee. Further reduction in ball flight distance is experienced with unwanted ball spins produced by friction and leaned ball on the concaved tee top surface.

In order to prevent reduction in ball flight distance and direction, time consumption and tee loss, and to secure repeated tee use, several anchoring devices have been suggested and developed. One of such suggested anchoring devices comprises a ball support tee and an anchoring element for tethering the ball support tee to the ground. Unfortunately, none of them are designed to solve the above mentioned five major defects all together in a simple one-piece configuration for convenience of a golfer to use time after time.

For example, see U.S. Pat. Nos. 4,645,208; 5,242,170; 5,413,348 and 7,011,586.

Another prior art U.S. Pat. No. 1,623,782 suggested the use of one or more barbs, flukes or hooks for anchoring devices. The barbs or flukes are designed not to come off by digging into the ground with their sharp edges when they are to be pulled out. The barbs resist to come off by catching the ground but is not designed to hold the ground with its wide ground holding angled fin toward incoming impact. The golf tee itself is made by metal such as aluminum with potential damages to recent titanium heads of golf clubs.

Another prior art Ortiz (US Pub. 2005/0064959) suggested the use of two anchoring fins extended out from the bottom section of round pointing tee shaft, wherein the two fins are positioned at 90 degrees perpendicular to the direction of impact and an elongated plate-shaped shaft is aligned to be flexible to deflect energy along the direction of ball impact. The anchoring fins are positioned at 90 degrees with respect to the elongated energy-deflecting plate-shaped shaft. This prior art in use may provide some form of anchoring device but anchoring ability of the tee to the ground is substantially limited, because Ortiz's elongated energy-deflecting plate-shaped shaft is aligned to the direction of the incoming impact, thus the elongated plate-shaped shaft is to lose its flexibility in the direction of coming impact and create unwanted plate shaft twist while pulling tee out of the ground. It further produces unwanted ball side spins to make a golf ball flies away from a targeted direction. As another disadvantage of Ortiz's fins, they are extended out from the bottom at a round-shaped center pointing stem which reduces the ability to hold the soil between fins due to its round shape.

Another prior art Lu (U.S. Pat. No. 7,156,758) suggested to use a cylindrical collar as power deflection device. The suggested tee comprises a separate upper portion and a separate lower portion that are axially aligned and enclosed within the flexible collar. However, this suggested anchoring device is not simple or one-piece configuration.

SUMMARY OF THE INVENTION

The present invention provides a golf tee having an anchoring device, an impact energy deflection device and a friction and a lean reduction device in one-piece configuration. The present invention provides a golf tee with the anchoring device which comprises two angled anchoring fins spaced apart at 140 degrees (less than 180 degrees) each other and fixed around a round-shaped cylindrical main shaft to extend out upward from a pointed bottom stem section of the golf tee to the height of the anchoring fins. The height of the anchoring fins is determined to remain in the ground when the golf tee is in use. A 140 degrees angled side of the shaft in the anchoring device facing the target direction of a ball has a shaft cutout portion 17 instead of its full size round-shaped cross section for enhancement of anchoring ability. According to the present invention, the anchoring device of the golf tee further comprises a third fin, that is, a tee recoil/dislodge prevention fin which is about half the length of the angled anchoring fins on the lower opposite side. The function of the recoil or dislodge prevention fin is to prevent the golf tee from slipping off the ground when the golf tee draws back or rebounds after impact. The recoil/dislodge prevention fin is different in length and height from the two anchoring fins in order to achieve its function, so that the recoil/dislodge prevention fin is buried completely and deeply into the ground when the golf tee is in use in the golf course. The anchoring fins catch the ground due to their wider area, while the recoil/dislodge fin holds the ground due to its angled or sharpened area. The recoil/dislodge prevention fin should be positioned directly opposite to the ball impact direction.

The energy deflecting device of the golf tee according to the present invention has gradual diameter reduction of the cylindrical shaft toward the top of the golf tee. A concaved cavity top surface of the golf tee is equipped with three dimples on its periphery as the friction and the lean reduction device. Only three dimples are holding the ball on a concaved cavity top and so designed the height of dimples to make the unbalanced leaned ball to fall off from the tee. All above three devices are implemented with one-piece configuration which is made of substantially indestructible, flexible and reusable plastic or other material which is adapted to serve the purpose to prevent the unwanted loss of the tee, the repeated use, and an added feature for more ball flight in the air.

BRIEF DESCRIPTION OF THE DRAWINGS

The present invention will become readily apparent upon reading the following detailed description and upon reference to the drawings in which:

FIG. 1(*b*) is a side view of the golf tee of FIG. 1(*a*), showing the two anchoring fins and a recoil/dislodge prevention fin which is about a half the size of the anchoring fins positioned directly opposite side of the angled anchoring fins;

FIG. 1(*c*) is a rear view of the golf tee of 1(*a*);

FIG. 2(*b*) is a view from the bottom of the golf tee of FIG. 1(*b*);

FIG. 2(*c*) is a view from the bottom of the golf tee illustrated in FIG. 1(*c*);

FIG. 5(*b*) is a view from the bottom of the golf tee illustrated in FIG. 5(*a*);

FIG. 6(*b*) is a view from the bottom of the golf tee illustrated in FIG. 6(*a*);

FIG. 7(*b*) is a view of anchoring fins from the bottom of FIG. 7(*a*).

DETAILED DESCRIPTION OF THE INVENTION

In order to gain the maximum ground holding ability of a golf tee, two anchoring fins must be aligned at an angle of 180 degrees toward the incoming impact. However, the golf tee is conventionally made by flexible materials, so if an angle of 180 degrees is set to the two anchoring fins which will widen more than 180 degrees at impact, resulting in reduction in its ability to hold the ground by slipping to hold the ground. On the other hand, if an angle of 120 degrees is set to the two anchoring fins which is too narrow to hold the maximum soil, even the two anchoring fins become expanded wider at impact, resulting in reduction in its ability to hold the ground. After a number of on-site tests, the inventor discovered that an angle of 140 degrees is most preferable for the two anchoring fins in combination with a shaft cutout portion 17 in the center at angled fin side instead of its full size round-shaped cross section in order to increase the resiliency of the golf tee to remain on the ground by exposing fin maximum ground holding area with the smallest anchoring fins by widening its angle to hold more of the ground at impact but not exceeding to widen more than 180 degrees. In order to achieve the maximum ground holding angle by angled fin, the angle of the two anchoring fins can be varied about 165 to 140 degrees, depending on the flexibility of fin material.

Figures 1, 2, 3, 4:
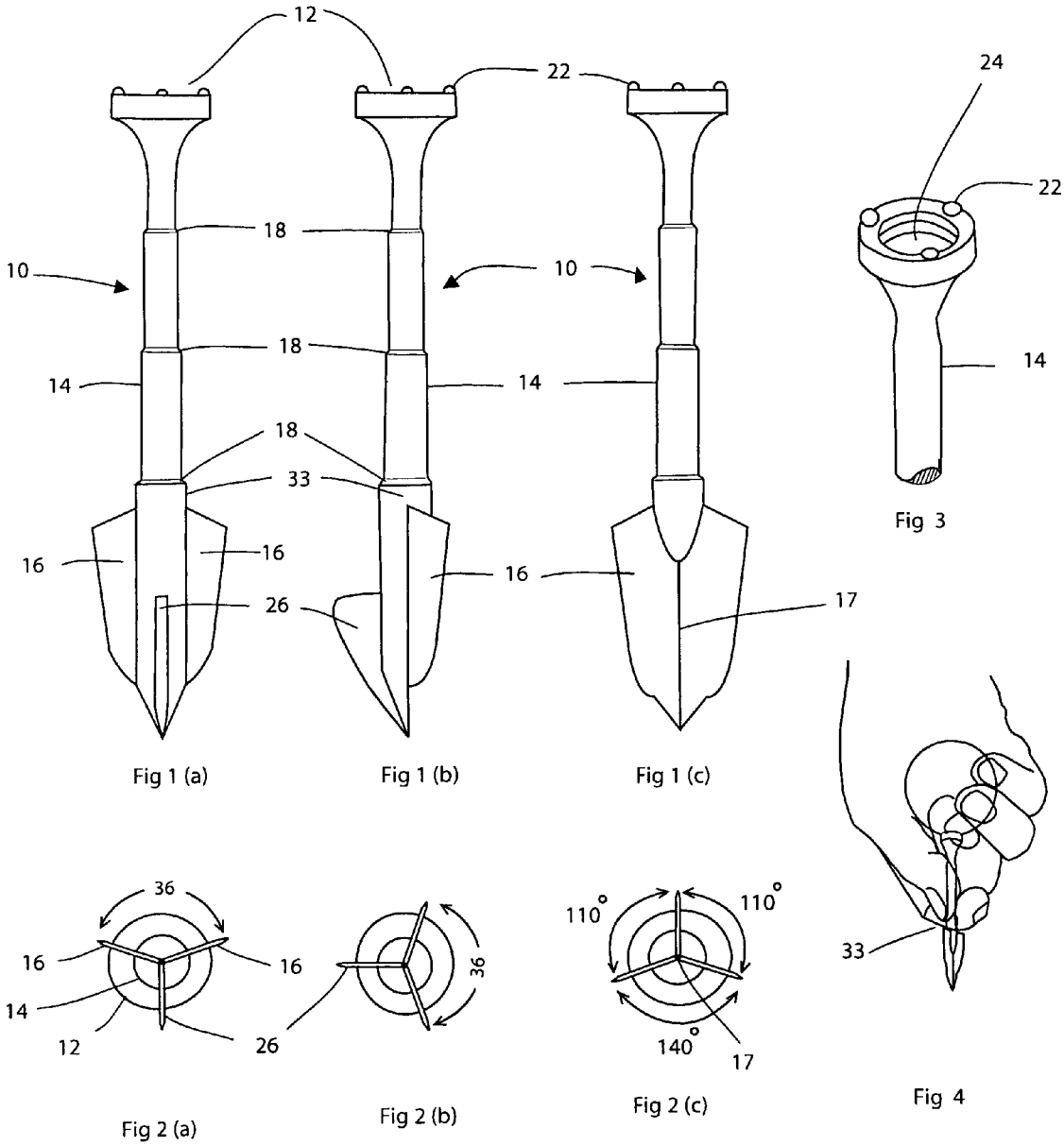
FIG. 1(*a*) is a front view of a golf tee designed for use with wood golf clubs (driver) embodying the principles of features of the present invention.
FIG. 2(*a*) is a view from the bottom of the golf tee illustrated in FIG. 1(*a*)
FIG. 3 is a perspective view of a concaved cavity top surface of the golf tee with three dimples on its periphery to lift the ball up in the air in order to reduce ball friction against the top surface of the golf tee and to create ball even balance on the three dimples.
FIG. 4 is a perspective view of a golf tee holding method according to the present invention in order to stick the golf tee into the ground with a golf ball in the cavity of the top surface, while holding at the anchor section shaft with index and thumb fingers, by pushing the ball down with a palm to the ground together.

Referring now to the attached drawings, there is illustrated a golf tee with an anchoring device, an impact deflection and a friction and lean reduction device in one-piece configuration according to an embodiment of the present invention. The golf tee 10 as illustrated in FIGS. 1(*a*), 1(*b*) and 1(*c*) has two anchoring fins 16 in order to expose maximum ground holding space toward incoming initial impact and fixed around a round-shaped cylindrical main shaft to extend out upward from a pointed bottom stem section of the golf tee to the height of the anchoring fins. The height of the anchoring fins 16 is determined to remain in the ground when the golf tee is in use. A 140 degrees angled side of the shaft in the anchoring device facing the target direction of a ball has a shaft cutout portion 17 instead of its full size round-shaped cross section for enhancement of anchoring ability.

According to an illustrated embodiment of the present invention, the anchoring device of the golf tee further comprises a third fin, that is, a tee recoil/dislodge prevention fin 26 which is about half the length of the angled anchoring fins on the lower opposite side. The function of the recoil or dislodge prevention fin 26 is to prevent the golf tee from slipping off the ground when the golf tee draws back or rebounds after impact. The recoil/dislodge prevention fin 26 is different in length and height from the two anchoring fins in order to achieve its function, so that the recoil/dislodge prevention fin 26 is buried completely and deeply into the ground when the golf tee is in use in the golf course. The anchoring fins 16 catch the ground due to their wider area, while the recoil/dislodge fin 26 holds the ground due to its angled or sharpened area. The recoil/dislodge prevention fin 26 should be positioned directly opposite to the ball impact direction.

The golf tee has a cylindrical main shaft at hits center has the impact deflection device which comprises a diameter reduction section 18 toward the top of the golf tee.

The golf tee further has the frinction and the lean reduction device which comprises a ball supporting concaved cavity top surface 12 with three dimples 22 on the periphery of the concaved cavity top surface to lift the ball up in the air to reduce ball friction and lean against tee top surface. The ground, holding the golf tee anchoring device 16, is designated by 11.

The cylindrical main shaft or stem of the golf tee 10 having a round-shaped cross section except for the shaft cutout portion 17 is designated by 14. The anchoring device of the golf tee 10 is comprised of the two anchoring fins 16, a recoil or dislodge prevention fin 26 and a thickest part of the cylindrical main shaft 14 with a pointed bottom tip. The energy deflection device on the cylindrical main shaft 14 comprises the gradual diameter reduction section 18 toward the top 12 of the golf tee is to deflect impact energy at a tee top section 12 where the very initial impact to the tee arrives and to release the most impact energy at the tee top section before unwanted impact energy travels down to the anchoring device for dislodgement of the golf tee from the ground 11. The friction and the lean reduction device on the concaved top surface 12 has a ball-holding cavity in order to absorb impact energy by deforming its round shape into oval shape to prevent some unwanted impact energy travels down to the anchoring device for dislodgement of the golf tee from the ground 11. Further the number of the dimples 22 evenly distributed on the periphery of the top surface is limited to three to hold the golf ball in balance and reduces additional friction. The concaved cavity top periphery yet further supports a off balanced golf ball to fall off from the three dimples 22 on the periphery.

Preferably, the gradual diameter reduction stem energy deflecting section further comprises a depth indicator, which enables the golfer to obtain a consistent tee height each time the golf ball is teed up.

The golf tee 10 with the anchoring device, the energy deflection device, the friction and lean reducible device are made of a flexible but substantially indestructible, reusable material, as one-piece unit, that is, a proper plastic material such as high density polyethylene.

Advantageously, the golf tee incorporates the anchoring fins, the energy deflection section, the friction and lean reducible device and resiliency of the reusable material for the golf tee configuration are to prevent tee breakage and dislodgement due to the club head impact and allows the golf ball to fly further distance in the air and frequent use by golfers over and over again unlike the prior art.

Figure 5:
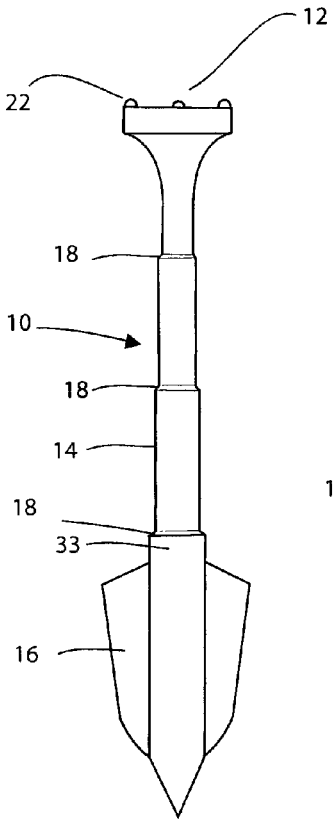
FIG. 5(*a*) is a front view of one variation of the golf tee of FIG. 1(*a*), by removing the recoil/dislodge prevention fin.
Figure 6:
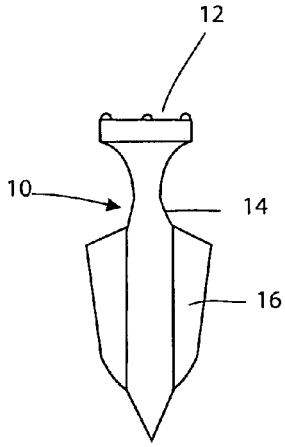
FIG. 6(*a*) is a front view of a golf tee designed for iron clubs with a shorter shaft without an energy deflection device illustrated in FIG. 5(*a*) as another feature of the present invention.
Figure 7:
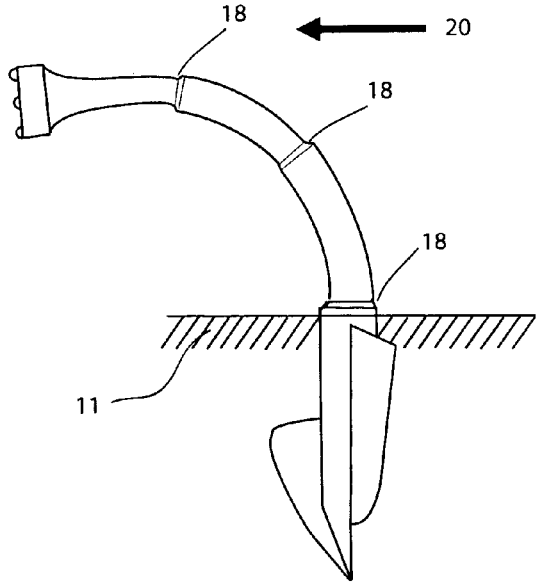
FIG. 7(*a*) is a side view of the golf tee stuck to the ground for use designed for wood golf clubs embodying the principles of feature of the present invention, illustrating the golf tee immediately after an impact with the anchoring fins facing toward incoming impact with results in the anchoring fins holding the ground and a gradual diameter reduction section swaying away at the tee top section.
Figure 5:
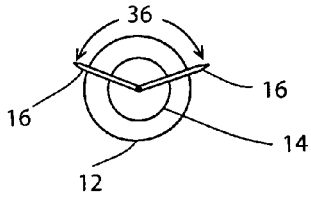
Figure 6:
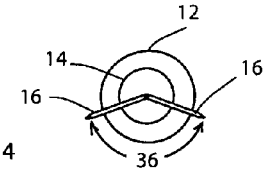
Figure 7:
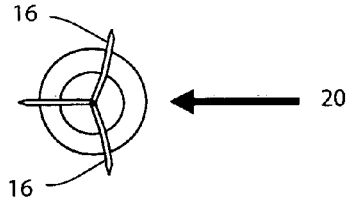

Although FIG. 5(*a*), and FIG. 6(*a*) show a variation of the anchoring device having the 140 degrees angled anchoring fins 16 without the tee recoil dislodge prevention fin 26.

The golf tee implementing the anchoring device, the impact energy deflection device, the friction and the lean reduction device in one-piece configuration according to the present invention enjoys the following advantages over the prior art golf tees.

First, as a tee anchoring device, the present invention comprises the two anchoring fins for initial impact resistance and the recoil dislodgement prevention fin after-impact resistance.

Second, as an energy deflection device which minimizes the absorption of the impact energy by golf tee. Third, the golf ball friction reduction device reduces less ball spin for more ball flight. Fourth, the golf ball lean reduction device reduces less ball side spin for straighter ball flight. Lastly, the golf tee combined with these four improvements, is made to stand with repeated use time after time.

While facilitating those advantages over previous arts, the present invention retains a strong resemblance to conventional golf tee to be accepted by the majority of golfers.

The anchoring device equipped with the angled anchoring fins, having a pointed inserting tee tip into the ground, by position a 140 degree fin angle toward an incoming impact angle, exposes more ground holding space between angled fin side by widening the fin more than 140 degrees but not more than 180 degrees at impact against the ground. The recoil dislodge prevention fin, designed to be half the length of the two anchoring fins on the lower opposite side of an angled fin, is on the other side of the direction of impact and remains inside the ground to hold ground when golf tee springs back after impact. The recoil dislodge prevention fin is positioned at angle of 110 degrees from the two anchoring fins.

The anchoring device combined with the two anchoring fins and the gradual diameter reduction energy deflect device toward tee top prevent the unwanted loss of tee by flying away at the golf club impact. Advantageously, the tee incorporates with the angled anchoring fins, the gradual diameter reduction toward tee top energy deflects section, the concaved cavity top surface and resilient reusable material for composition is to prevent tee breakage and dislodgement due to the club head impact.

The concaved tee top surface to hold ball is made cavity in order to somewhat deflect impact energy by deforming its round tee top shape to oval shape at impact and also to reduces tee contact surface to a ball.

The dimple is added on the cavity tee top brim and minimized to three dimples evenly distributed on the periphery of the cavity top surface in order to hold the ball in balance yet reduce friction to the least to lift the ball in the air. The dimple diameter is made slightly bigger than the depth of golf ball negative dimples in order to lift the ball clean up in the air in balance with the three dimples on the periphery of the concaved cavity top surface and no other section of tee top touches to the ball to reduce friction minimum.

Ball unbalanced placement on the tee produces more friction on the lower side which produces unwanted ball spins to make ball goes wrong direction. Therefore, the three dimples on the top surface are not only designed to reduce frictions but also designed to make the ball fall off if the ball is leaned too far on either side in order to prevent ball unbalance placement on the tee for true straighter ball flight toward target.

As compared with the Ortiz prior art, the present invention has the 140 degree angled anchoring fins with no round-shaped shaft section in the center at angled side. The angled fin application toward incoming impact direction combined with the tee recoil dislodge prevention fin on the opposite side of the angled fin significantly increases the resiliency of the golf tee and its ability to withstand impact compare to Ortiz. It means that the more soil will enter there in between the angled fin without widening more than 180 degrees at impact and serve to firmly retain the golf tee in position, incorporated with energy deflect device with gradual shaft diameter step down design toward concaved cavity tee top facilitated with three imples on the brim to lift ball up in the air for friction and lean reduction. The advantageous and novel features of the invention will be readily apparent.

As compared with the Lu prior art, the present invention power deflection device uses a same material and equipped with gradual tee shaft diameter step down in order to gain flex point toward cavity tee top where initial impact takes place. The simplest method of minimizing the absorption of impact energy by the golf tee is to reduce shaft strength by reducing the shaft diameter toward tee top section where the initial impact takes place. Thus, the present invention applied gradual shaft diameter reduction design toward cavity tee top to sway the initial impact energy at the tee top section instead of middle or lower section a tee. The advantageous and novel features of the invention will be readily apparent.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A golf tee with anchoring device, impact energy deflection device, friction and lean reduction device in one-piece configuration, comprising:

a cylindrical main shaft with pointed stem at the bottom;

an anchoring device having two anchoring fins fixed at the main shaft at an angle of 165 to 140 degree with a shaft cutout portion in the center of the angled anchoring fins side, said anchoring device further comprising a recoil dislodge prevention fin on the opposite side of the angled anchoring fins, said recoil dislodge prevention fin being half the length of the anchoring fins and at the bottom pointed tee section so as to be inserted deeply into the ground and provide an angled fin facing toward incoming impact;

an impact energy deflection device comprising a gradual diameter reduction of the main shaft toward the top of the golf tee; and a friction and a lean reduction device comprising a concaved cavity tee top surface having three dimples equally distributed on the periphery of the concaved cavity top surface;

wherein the tee main shaft with a pointed stem at the bottom comprising with the 165 to 140 degrees angled anchoring fins, the recoil dislodge prevention fin, the energy deflecting device, and the friction and lean reduction device is made of substantially flexible but indestructible, reusable plastic material as an one piece tee unit.

2. The golf tee with the anchoring device as defined in claim 1 wherein the anchoring fins at the bottom section of the main shaft at a pointed stem section include an 165 to 140 degree angled anchoring fin with shaft cut out portion and tee recoil dislodge prevention fin positioned on the opposite side of the angled fin, and gradually merging toward the bottom of pointed stem to enforce the bottom shaft section at the opposite side of angled fin where the shaft portion is removed from the center of the angled fin.

3. The golf tee with the energy deflection device as defined in claim 1 wherein the energy deflecting device having the gradual cylindrical diameter reduction stem section toward the top of the golf tee is thinner at a top section than a lower section of the shaft to sway impact energy away at the top section of the golf tee before the direct impact energy travel down to the anchoring fins.

4. The golf tee with the energy deflection device as defined in claim 1 wherein the gradual diameter reduction stem energy deflecting section further comprising as a depth indicator, where in the depth indicator enables golfer to obtain a consistent tee height each time a golf ball is teed up.

5. The golf tee friction reduction device defined in claim 1 wherein the friction and lean reduction device includes a concaved cavity surface with three dimples evenly placed on the periphery of the top surface of the golf teen to hold the ball in balance with little friction.

6. The golf tee with the anchoring device as defined in claim 1 wherein the angle of the two anchoring fins is selected within a range of about 165 to 140 degrees, depending on the flexibility of fin material.

* * * * *